US008425198B2

(12) United States Patent
Tanaka et al.

(10) Patent No.: US 8,425,198 B2
(45) Date of Patent: Apr. 23, 2013

(54) AIR COMPRESSOR

(75) Inventors: Hideharu Tanaka, Shizuoka (JP); Masahiko Takano, Shizuoka (JP); Akihiro Nagasaka, Shizuoka (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 196 days.

(21) Appl. No.: 12/700,189

(22) Filed: Feb. 4, 2010

(65) Prior Publication Data

US 2010/0232980 A1 Sep. 16, 2010

(30) Foreign Application Priority Data

Mar. 13, 2009 (JP) ..... 2009-061416

(51) Int. Cl.
*F04B 49/00* (2006.01)

(52) U.S. Cl.
USPC ..... 417/12; 417/32; 417/44.1

(58) Field of Classification Search ..... 417/12, 417/32, 44.1
See application file for complete search history.

(56) References Cited

U.S. PATENT DOCUMENTS 4,722,019 A * 1/1988 Pohl ..... 361/22
5,345,126 A * 9/1994 Bunch ..... 310/68 C
5,463,874 A * 11/1995 Farr ..... 62/126
5,784,232 A * 7/1998 Farr ..... 361/22
6,939,631 B2 * 9/2005 Formanski et al. ..... 429/437
2009/0016921 A1 * 1/2009 Fujimoto et al. ..... 418/201.1

FOREIGN PATENT DOCUMENTS

| | | | |
|---|---|---|---|
| JP | 08-004680 | | 1/1996 |
| JP | 2003-206864 | A | 7/2003 |
| JP | 2005-61402 | A | 3/2005 |
| JP | 2006-316696 | A | 11/2006 |
| JP | 2007-146698 | A | 6/2007 |
| JP | 2007146698 | A * | 6/2007 |
| JP | 2008-128052 | A | 6/2008 |
| JP | 2009-13843 | A | 1/2009 |
| WO | WO 2007/009669 | A2 | 1/2007 |

OTHER PUBLICATIONS

Machine translation of JP2007-146698-A, published Jun. 2007.*
Machine translation of JP08-004680, published Jan. 1996.*
Japanese Office Action mailed Feb. 19, 2013 and partial English language translation thereof.

* cited by examiner

*Primary Examiner* — Devon Kramer
*Assistant Examiner* — Thomas Fink
(74) *Attorney, Agent, or Firm* — Crowell & Moring LLP

(57) ABSTRACT

An air compressor 20, for enabling to restart a fan motor when an inverter trip generates within an inverter control of the fan motor, as well as, to continue supplying of compressed air therefrom, comprises: a compressor main body 1; a compressor motor 2 for driving this compressor main body 1; a fan motor 9*b* for driving a fan 9*a*; an inverter for controlling the fan motor; and a controller 10 for controlling driving of the compressor motor 2 and driving of the fan motor 9*b*. The controller 10 conducts such control that the fan motor 9*b* is brought into a restart waiting condition while continuing operation of the compressor motor 2 when an inverter trip generates, and thereafter to restart the fan motor 9*b*.

6 Claims, 5 Drawing Sheets

AIR COMPRESSOR

This application relates to and claims priority from Japanese Patent Application No. 2009-061416 filed on Mar. 13, 2009, the entire disclosure of which is incorporated herein by reference.

BACKGROUND OF THE INVENTION

The present invention relates to an air compressor, and in particular, it relates to an air compressor suitable for controlling a cooling fan through an inverter.

Requirements for lowering electric power consumption and noises of an air compressor are increasing. In addition to a variable speed control provided by means of an inverter within a main body of the compressor, developments are also made to a variable speed control provided by means of the inverter for a fan motor to be used in a heat exchanger. With an inverter control of the fan motor, since a rotation speed of the fan motor can be increased or decreased depending upon an increase/decrease of a load needed, the advantage of achieving the lowering of electric power consumption and of noises can be obtained.

An example of applying an inverter control to the cooling fan of the air compressor is provided by a screw compressor which is shown in Patent Document 1 identified below. The screw compressor of Patent Document 1 comprises a main compressor body having a pair of male/female screw rotors, an air-cooled type cooler for compressor lubrication oil, an air-cooled type cooler for compressed air, a cooling fan for supplying cooling air to the main body of the compressor and the air-cooled type coolers mentioned above, an inverter for controlling the rotation speed of the cooling fan, a first sensor for detecting temperature of the lubrication oil, a second sensor for detecting temperature of a suction air, and a cooling fan controller.

The control of the cooling fan controller has a memory portion for memorizing the setup temperature of the lubrication oil and the setup temperature of the suction air, and a calculation portion for calculating a control signal for increasing the rotation speed of the cooling fan mentioned above when a detected value of temperature of the lubrication oil from the first sensor becomes higher than the setup temperature, which is memorized in the memory portion, or for calculating a control signal for increasing the rotation speed of the cooling fan when a detected value of temperature of the suction air from the second sensor becomes higher than the setup temperature of the suction air, which is memorized in the memory portion mentioned above.

PRIOR ART DOCUMENTS

Patent Documents

[Patent Document 1] Japanese Patent Laying-Open No. 2009-13843 (2009).

BRIEF SUMMARY OF THE INVENTION

In Patent Document 1 mentioned above, it is disclosed that the rotation speed of the cooling fan is controlled by means of the inverter; however no disclosure is made in relation to the control when an inverter trip is generated.

In a general air compressor, wherein the cooling fan is controlled through the inverter, even when a temporary and insignificant external disturbance is generated on a power source line, such as instantaneous voltage drop or the like, for example, the inverter is stopped for the purpose of protecting the inverter of the cooling fan (i.e., generating the inverter trip). During this time period, the operation of the main body of the compressor is also stopped at the same time. For this reason, with the general air compressor, in which the cooling fan is controlled through the inverter, a degree of tolerance is less with respect to the temporary external disturbance on the power source line in comparison with the air compressor, in which the cooling fan is not controlled through the inverter.

An object according to the present is to provide an air compressor for controlling the fan motor through the inverter, so that the fan motor can be restarted even if the inverter trip is generates, thereby enabling compressed air to be supplied continuously.

For accomplishing the object mentioned above, according to the present invention, there is provided an air compressor, comprising: a compressor main body; a compressor motor, which is configured to drive said compressor main body; a fan motor, which is configured to drive a fan; an inverter, which is configured to control said fan motor; and a controller, which is configured to control driving of said compressor motor and driving of said fan motor, wherein said controller conducts such control that said fan motor is brought into a restart waiting condition while continuing operation of said compressor motor when an inverter trip generates, and thereafter to restart said fan motor.

More preferable detailed structures, according to the present invention, are as follows:

(1) The control is so made that said fan motor is restarted after elapsing a predetermined time from when said controller brings said fan motor into the restart waiting condition.

(2) Said controller detects whether the inverter trip is ended or not, so as to conduct a control that restarts said fan motor when the inverter trip is ended, while it continues the restart waiting condition of said fan motor when the inverter trip is not ended, to thereby restart said cooling fan thereafter.

(3) A temperature detector means detects air temperature discharged by said compressor main body so that said controller conducts control of restarting said fan motor when the discharged air temperature detected by said temperature detector means is lower than an upper limit value, which is determined in advance.

(4) A temperature detector means also detects air temperature discharged by said compressor main body so that said controller conducts control of stopping said compressor motor when the discharged air temperature detected by said temperature detector means reaches an upper limit value, which is determined in advance, during the restart waiting time of said fan motor.

With such an air compressor, according to the present invention, it is possible to provide the air compressor for controlling the fan motor through the inverter, so that the fan motor can be restarted even if an inverter trip is generated, thereby enabling compressed air to be supplied continuously.

BRIEF DESCRIPTION OF THE SEVERAL VIEWS OF THE DRAWING

Those and other objects, features and advantages of the present invention will become more readily apparent from the following detailed description when taken in conjunction with the accompanying drawings wherein.

DETAILED DESCRIPTION OF THE PREFERRED EMBODIMENTS

Figure 1:
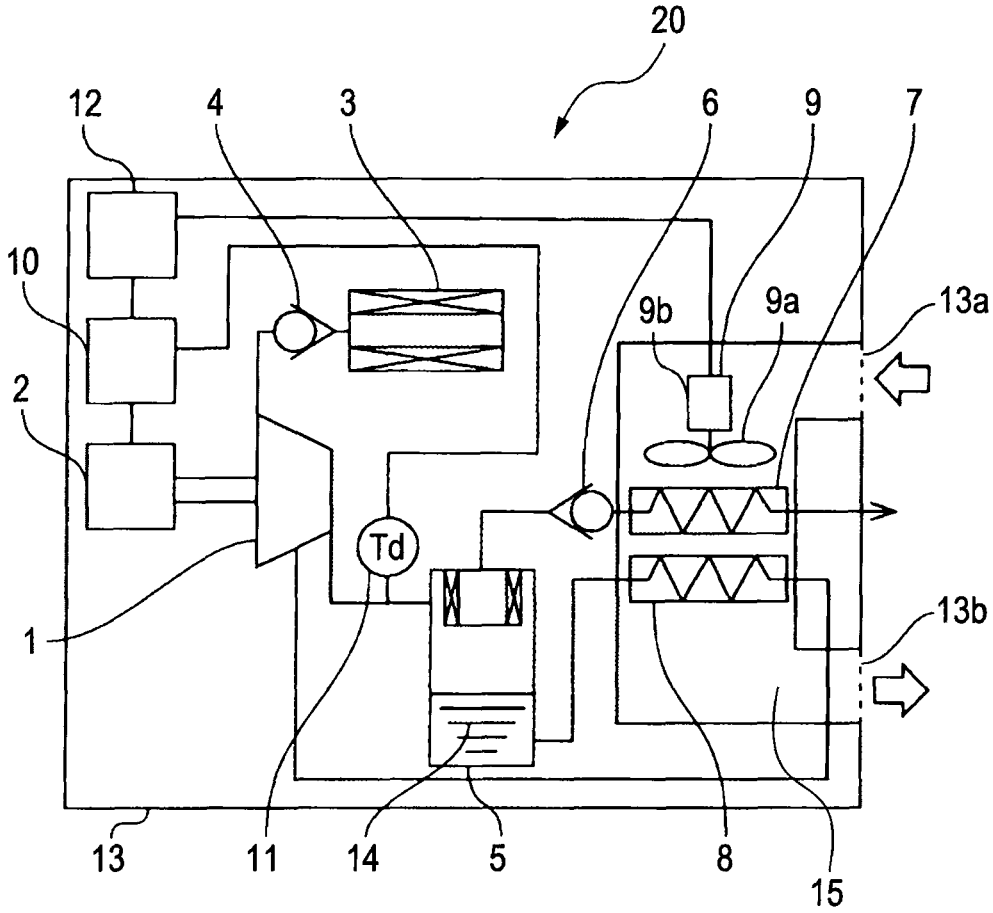
FIG. 1 is a view showing the entire configuration of an air compressor, according to a first embodiment of the present invention.

Hereinafter, embodiments according to the present invention will be fully explained by referring to the attached drawings. The same reference numerals in each of the figures showing the embodiments indicates the same thing or corresponding things.

First Embodiment

An explanation will be made of an air compressor, according to the first embodiment of the present invention, by referring to FIGS. 1 to 4.

First of all, an explanation will be made, in relation to the structures and functions of an entire air compressor 20, according to the present embodiment, by referring to FIG. 1. FIG. 1 is a view of the structure of the air compressor 20 according to the present invention. The air compressor 20 according to the present embodiment is a screw compressor, for example.

A compressor main body 1 is constructed by accommodating therein a pair of male/female screw rotors, which are engaged or meshed with each other and which are driven by a compressor motor 2. With a suction filter 3, one side thereof is communicated with a suction side of the compressor main body 1, while the other side thereof is communicated with the atmosphere.

When the compressor motor is driven, the compressor main body 1 sucks air in the atmosphere through the suction filter 3 and a suction check valve 4 therein, and, after compressing this air in the atmospheric up to a predetermined pressure, it discharges it as compressed air therefrom.

An oil separator 5 is provided on a discharge side of the compressor main body 1. One side of a compressed-air heat exchanger 7 is communicated with an upper portion of the oil separator 5, and the other side of a compressed-air heat exchanger 7 is guided into an outside of a package 13. The check valve 6 is provided between the oil separator 5 and the compressed-air heat exchanger 7. One side of a lubrication-oil heat exchanger 8 is communicated with an oil-accumulating portion in a lower portion of the oil separator 5, and the other side of the lubrication-oil heat exchanger 8 is communicated with a middle portion of a compressing chamber of the compressor main body 1.

The compressed-air heat exchanger 7 and the lubrication-oil heat exchanger 8 are disposed within a ventilation duct 15, together with that ventilation duct 15. The ventilation duct 15 is communicated with an outside of the package 13 through a suction air inlet 13*a* and a blowout air outlet 13*b* of the package 13. A cooling fan 9 is constructed with a fan 9*a*, operating to suck an outside air from the suction air inlet 13*a* and to blow out it from the blowout air outlet 13*b*, and a fan motor 9*b* for driving the fan 9*a*. The compressed-air heat exchanger 7 and the lubrication-oil heat exchanger 8 perform the heat exchange between the outside air through ventilation by the cooling fan 9.

The compressed air, including the lubrication oil therein, which is compressed and discharged from the compressor main body 1, after being separated from the lubrication oil 14 within the oil separator 5, is transferred to the compressed-air heat exchanger 7 through the check valve 6, and after being cooled down within the compressed-air heat exchanger 7, it is discharged into an outside of the package 13. On the other hand, the lubrication oil 14, which is separated from the compressed air within the oil separator 5, is transferred to the lubrication-oil heat exchanger 8, and after being cooled down within the lubrication-oil heat exchanger 8, again, it is supplied to the compressor main body 1.

The compressor motor 2 and the fan motor 9*a*, which is driven through a fan inverter 12, are controlled by a controller 10. Also, downstream of the compressor main body 1, a temperature detector means 11 is provided for detecting discharge air temperature of the air, which is discharged from the compressor main body 1. The controller 10 compares a detection value "Td" of the temperature detector means 11 with an upper limit value "Tdh" of discharge gas temperature, which is determined or set up in advance, and when Td>Tdh, it determines that the compressor motor is in an abnormal condition, and stops the operation thereof, thereby stopping the operation of the compressor main body 1.

Figure 2:
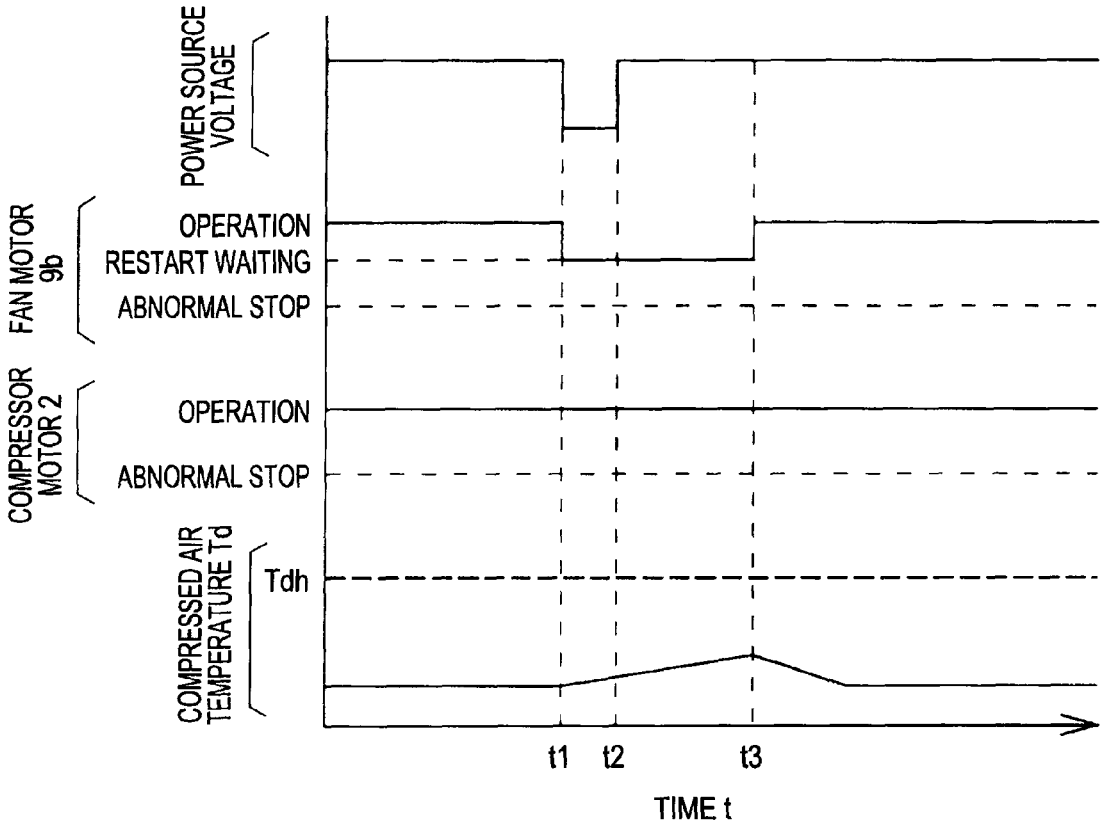
FIG. 2 is a time chart showing a first control (control 1) of the air compressor, according to the first embodiment.
Figure 3:
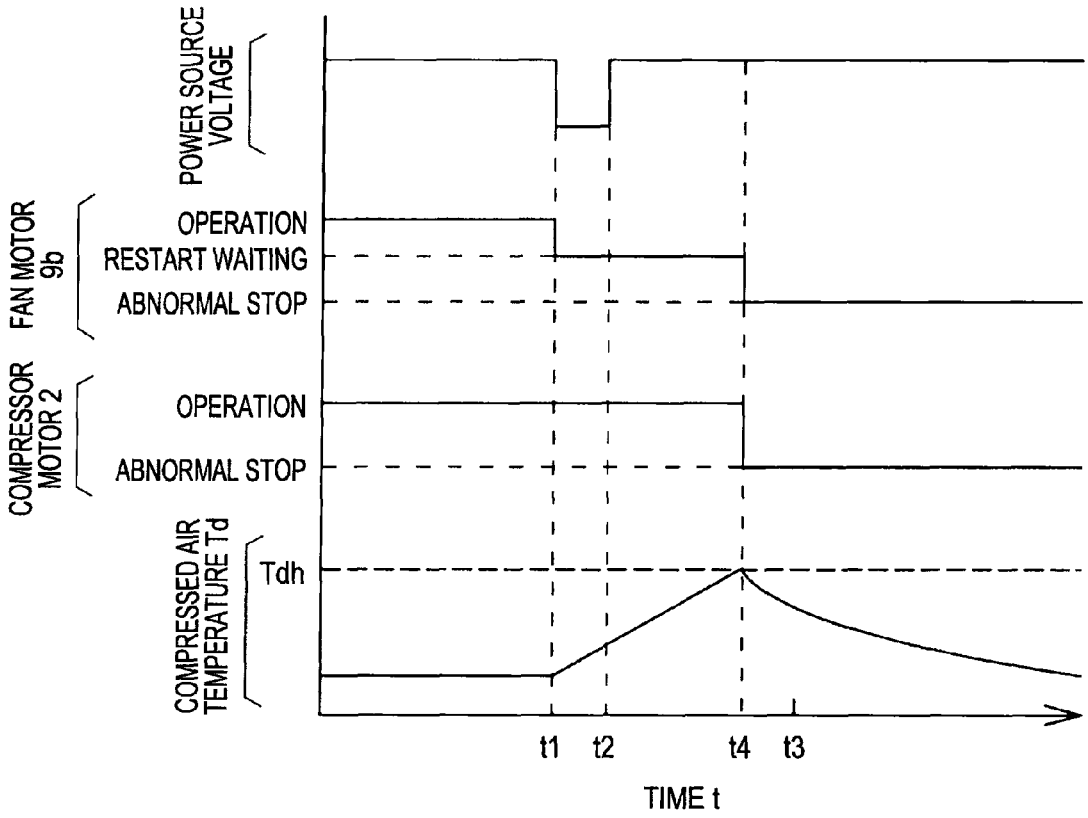
FIG. 3 is a time chart for showing a second control (control 2) of the air compressor, according to the first embodiment.

Next, an explanation will be made of a control example in a case where the instantaneous voltage drop occurs, as a representative example of the temporary external disturbance, and the inverter trip is generated, by referring to FIGS. 2 and 3. FIG. 2 shows a control example 1, and FIG. 3 shows a control example 2, respectively. In control examples 1 and 2, at a time t=t1, the instantaneous voltage drop is generated (i.e., starting the inverter trip), and at a time t=t2, it is restored (i.e., the inverter trip is ended).

Explanation will now be given of a control made by the controller 10, in the control example 1 shown in FIG. 2. When the fan inverter 12 detects the instantaneous voltage drop generated at the time t=t1 on a power source voltage, then the fan motor 9*b* is stopped, once, and at the same time, control is done so as to bring fan motor 9*b* into a restart waiting condition, to continue the operation of the compressor motor 2. Herein, in case where Td<Tdh after comparing the upper limit value of discharge gas temperature "Tdh" and the detection value "Td" of the temperature detector means 11, control is made so that the compressor motor 2 can operate continuously.

Then, while measuring a predetermined time that is set up in advance, i.e., a restart waiting time, using a timer, the detection value "Td" of the temperature detector means 11 is compared with the upper limit value of discharge gas temperature "Tdh", and when Td<Tdh, such control is made that the compressor motor 2 is operated continuously.

At a time t=t3 after the restart waiting time elapses, a determination is made if the voltage drop of the power source line is ended or not (in other words, the power source voltage is restored or not, or the inverter trip is ended or not), and then, if the determination is that it is ended, the fan motor 9*b* is restarted, to turn back to a normal operation thereof.

With provision of this control example 1, it is possible to continue the supply of compressed air, while enabling the restart of the fan motor when the inverter trip is generated within the inverter controlling of the fan motor.

Explanation will now be made of the control of the controller 10 in a control example 2, which is shown in FIG. 3. In this discussion, explanation will be given only with respect to aspects differing from those of the control example 1, and explanation of other aspects duplicating those of the control example 1 will be omitted herein.

When Td≧Tdh at a time t=t4 before the time t=t3 under the restart waiting condition of the fan motor 9*b*, at the time t=t4, control is conducted so that the fan motor 9*b*, which was under the restart waiting condition, is brought into a condition of an abnormal stoppage, and at the same time, the operation of the compressor motor 2 is also in the abnormal stoppage. With this control, it is possible to maintain reliability of the compressor main body 1.

Figure 4:
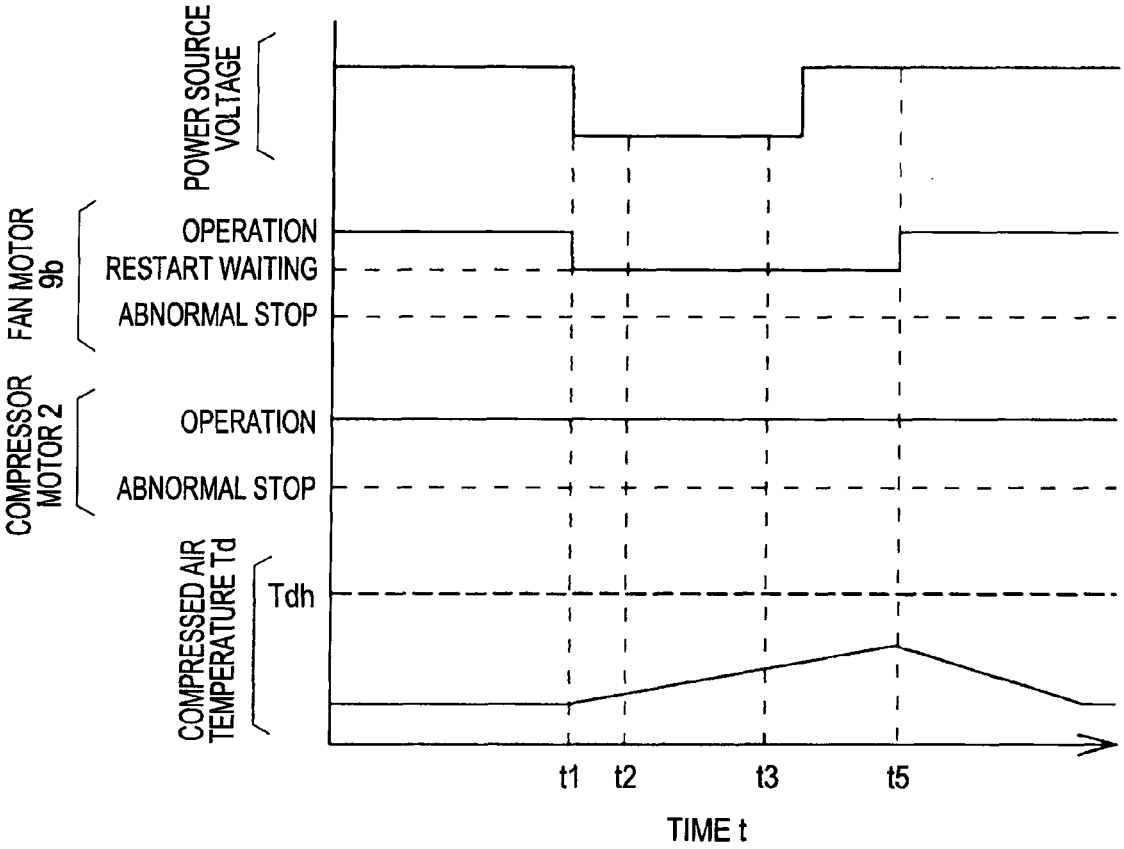
FIG. 4 is a time chart for showing a third control (control 3) of the air compressor, according to the first embodiment.

Next, an explanation will be given of a control example 3 when the voltage drop is generated a little bit longer than the restart waiting time, as the temporary external disturbance, by referring to FIGS. 3 and 4. In control example 3, the explanation will be given only with respect to aspects differing from those of the control example 1, and explanation of other aspects duplicating those of the control example 1 will be omitted herein.

The control example 3 is an example of a case where the voltage drop occurs (i.e., the inverter trip starts) at the time t=t1, and the power source voltage is restored at a time t=t5 after the time t=t3 elapses.

At the time t=t3 after the first restart waiting time elapses, determination is made on if the voltage drop on the power source line is ended or not, and when it is not ended, such control is made that the fan motor 9*b* can continue to be in the restart waiting condition and the compressor motor 2 can continue the operation thereof.

Then, while measuring a second predetermined time, which is set up in advance, i.e., a second restart waiting time, using a timer, the detection value "Td" of the temperature detector means 11 is compared with the upper limit value of discharge gas temperature "Tdh", and when Td<Tdh, such control is made that the compressor motor 2 is operated continuously. In order not to elongate the time from "t1" to "t5" excessively, it is preferable to have the second restart waiting time be shorter than the first restart waiting time.

Ata time t=t5, after the second restart waiting time elapses, a determination is made as to whether the voltage drop of the power source line is ended or not, and if it is ended, then the fan motor 9*b* is restarted, to turn back to a normal operation thereof.

With provision of this control example 3, it is also possible to determine if the first restart waiting time is short, and if determining this time to be short, it is then possible to restart the fan motor within a short time, thereby to turn back to the normal operation thereof.

Second Embodiment

Figure 5:
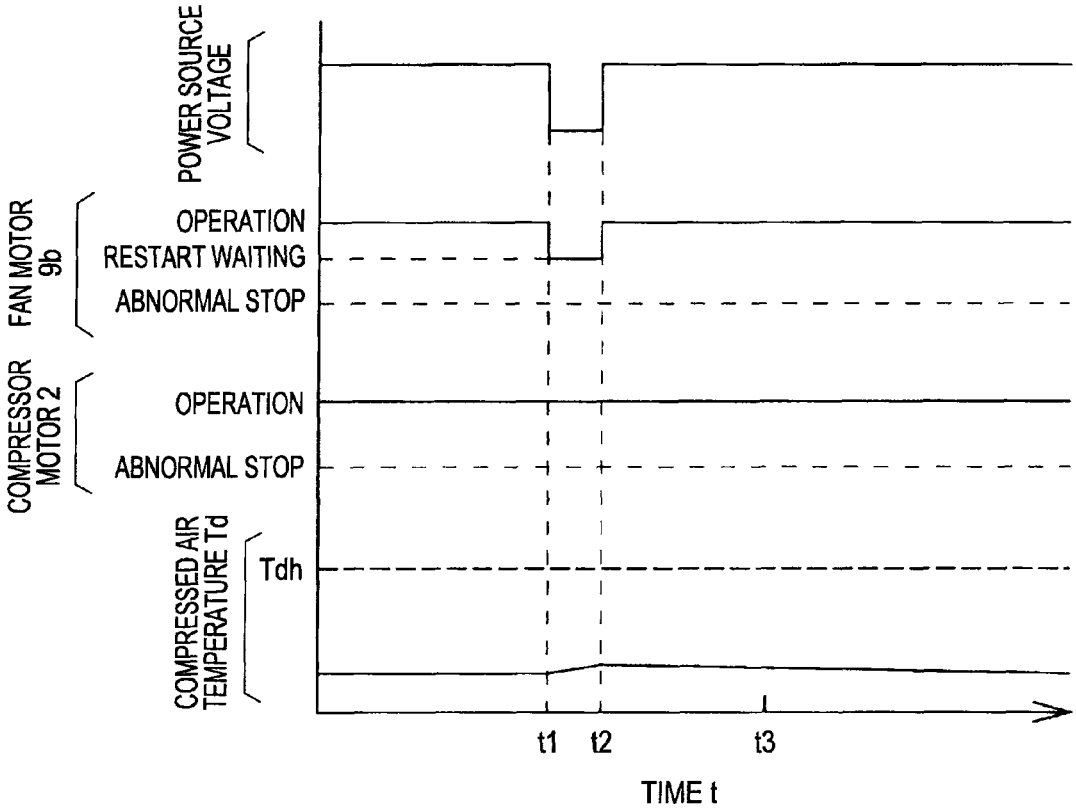
FIG. 5 is a time chart for showing a fourth control (control 4) of the air compressor, according to a second embodiment.

Next, an explanation will be made of an air compressor 20, according to a second embodiment of the present invention, by referring to FIG. 5. This FIG. 5 is a time chart showing a control example 4 of the air compressor 20 according to the second embodiment.

In this control example 4, when the fan inverter detects the instantaneous voltage drop generating at the time t=t1 on the power source voltage, then the fan motor 9*b* is stopped, once, and at the same time, control is performed so as to bring fan motor 9*b* into a restart waiting condition, while continuing the operation of the compressor motor 2. When Td<Tdh after comparing the upper limit value of discharge gas temperature "Tdh" and the detection value "Td" of the temperature detector means 11, such control is made that the compressor motor 2 can operate, continuously. In this aspect, it is same as the control example 1.

Then, while measuring a predetermined time that is set up in advance, i.e., a restart waiting time, using a timer, the detection value "Td" of the temperature detector means 11 is compared with the upper limit value of discharge gas temperature "Tdh", and when Td<Tdh, such control is made that the compressor motor 2 is operated, continuously (as with the control example 1), and a further determination is made of whether the voltage drop on the power source line is ended or not. If the determination is that it is ended, then such control is made that the fan motor 9*b* can restart, so as to turn back to the normal operation thereof.

With this control example, since the fan motor can turn back to the normal operation at the same time when the inverter stop is ended, it is possible to stop or suppress an (ill) influence of the inverter trip to a minimum.

The present invention may be embodied in other specific forms without departing from the spirit or essential feature or characteristics thereof. The present embodiment(s) is/are therefore to be considered in all respects as illustrative and not restrictive, the scope of the invention being indicated by the appended claims rather than by the forgoing description and range of equivalency of the claims are therefore to be embraces therein.

What is claimed is:

1. An air compressor, comprising:

a compressor main body;

a compressor motor, which is configured to receive an electric supply from a power source voltage to rotate, thereby driving said compressor main body;

a fan motor, which is configured to drive a fan;

an inverter, which is configured to receive the electric supply from said power source voltage, thereby controlling a rotation speed of said fan motor; and a controller, which is configured to control driving of said compressor motor and driving of said fan motor, wherein said controller conducts a control so that said fan motor is stopped, to be brought into a restart waiting condition, while continuing operation of said compressor motor when said inverter starts a trip upon detection of an instantaneous drop in said power source voltage, and thereafter to restart said fan motor.

2. The air compressor as described in claim 1, wherein the control is so made that said fan motor is restarted after a predetermined time elapses from when said controller brings said fan motor into the restart waiting condition.

3. The air compressor as described in claim 2, wherein said controller detects whether the inverter trip is ended or not, so as to conduct a control such that it restarts said fan motor when the inverter trip is ended, while it continues the restart waiting condition of said fan motor when the inverter trip is not ended, to thereby restart said fan motor thereafter.

4. The air compressor as described in claim 2, further comprising a temperature detector means for detecting air temperature discharged by said compressor main body, wherein said controller conducts control of restarting said fan motor when the discharged air temperature detected by said temperature detector means is lower than a predetermined upper limit value.

5. The air compressor as described in claim 1, further comprising a temperature detector means for detecting air temperature discharged by said compressor main body, wherein said controller conducts control of stopping said compressor motor when the discharged air temperature detected by said temperature detector means reaches a predetermined upper limit value during the restart waiting time of said fan motor.

6. The air compressor as described in claim 2, further comprising a temperature detector means for detecting air temperature discharged by said compressor main body, wherein said controller conducts control of stopping said compressor motor when the discharged air temperature detected by said temperature detector means reaches a predetermined upper limit value during the restart waiting time of said fan motor.

* * * * *